US009499886B2

(12) United States Patent
Sato et al.

(10) Patent No.: US 9,499,886 B2
(45) **Date of Patent: *Nov. 22, 2016**

(54) NI-BASED SINGLE CRYSTAL SUPERALLOY AND TURBINE BLADE INCORPORATING THE SAME

(71) Applicant: IHI Corporation, Tokyo (JP)

(72) Inventors: Akihiro Sato, Yokohama (JP); Kazuyoshi Chikugo, Kawasaki (JP); Yasuhiro Aoki, Tokyo (JP); Nobuhito Sekine, Tokorozawa (JP); Mikiya Arai, Tokyo (JP); Shoju Masaki, Tokyo (JP)

(73) Assignee: IHI CORPORATION (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/743,833

(22) Filed: Jun. 18, 2015

(65) Prior Publication Data

US 2015/0292063 A1 Oct. 15, 2015

Related U.S. Application Data

(63) Continuation-in-part of application No. 12/530,900, filed as application No. PCT/JP2008/054387 on Mar. 11, 2008, now abandoned.

(30) Foreign Application Priority Data

Mar. 12, 2007 (JP) ..... 2007-061501

(51) Int. Cl.

| | |
|---|---|
| ***C22C 19/05*** | (2006.01) |
| ***F01D 5/28*** | (2006.01) |
| ***C22F 1/10*** | (2006.01) |

(52) U.S. Cl.

CPC ..... *C22C 19/057* (2013.01); *C22F 1/10* (2013.01); *F01D 5/28* (2013.01); *F01D 5/282* (2013.01); *F05D 2300/607* (2013.01)

(58) Field of Classification Search

CPC ..... C22C 19/057; C22F 1/10

See application file for complete search history.

(56) References Cited

U.S. PATENT DOCUMENTS

| | | | |
|---|---|---|---|
| 4,582,548 | A | 4/1986 | Harris et al. |
| 4,643,782 | A | 2/1987 | Harris et al. |

(Continued)

FOREIGN PATENT DOCUMENTS

| | | | |
|---|---|---|---|
| CA | 1315572 | C | 4/1993 |
| EP | 0 208 645 | | 1/1987 |

(Continued)

OTHER PUBLICATIONS

Choudhury, I. A., and M. A. El-Baradie. "Machinability of nickel-base super alloys: a general review." Journal of Materials Processing Technology 77.1 (1998): 278-284.*

(Continued)

*Primary Examiner* — Jessee Roe

(74) *Attorney, Agent, or Firm* — Ostrolenk Faber LLP

(57) ABSTRACT

A Ni-based single crystal superalloy which has the following composition: Co: 4.0 to 9.5 wt %, Cr: 5.1 to 8.0 wt %, Mo: 2.1 to 3.5 wt %, W: 0.0 to 2.9 wt %, Ta: 4.0 to 10.0 wt %, Al: 4.5 to 6.5 wt %, Ti: 0.0 to 1.0 wt %, Hf: 0.08 to 0.5 wt %, Nb: 0.0 to 3.0 wt %, Re: 4.5 to 8.0 wt % and Ru: 0.5 to 6.5 wt % with the remainder including Ni and unavoidable impurities, wherein $P1 \leq 700$ is satisfied in which P1 represents a parameter 1, which is obtained by a formula: $P1=137\times[W\ (wt\ \%)]+24\times[Cr\ (wt\ \%)]+46\times[Mo\ (wt\ \%)]-18\times[Re\ (wt\ \%)]$.

8 Claims, 9 Drawing Sheets

(56) References Cited

U.S. PATENT DOCUMENTS

| | | | | |
|---|---|---|---|---|
| 5,366,695 | A | 11/1994 | Erickson | |
| 5,482,789 | A | 1/1996 | O'Hara et al. | |
| 6,966,956 | B2 | 11/2005 | Koizumi et al. | |
| 8,877,122 | B2 * | 11/2014 | Aoki et al. | 420/444 |
| 2006/0011271 | A1 | 1/2006 | Kobayashi et al. | |
| 2006/0057018 | A1 | 3/2006 | Hobbs et al. | |
| 2008/0170961 | A1 * | 7/2008 | Seetharaman et al. | 420/445 |

FOREIGN PATENT DOCUMENTS

| | | | |
|---|---|---|---|
| EP | 0 848 071 | | 6/1998 |
| JP | 62-267440 | A | 11/1987 |
| JP | 6-10082 | A | 1/1994 |
| JP | 11-256258 | | 9/1999 |
| JP | 2005-097649 | | 4/2005 |
| RU | 2 153 021 | | 7/2000 |
| RU | 2 293 782 | | 2/2007 |
| WO | WO 03/080882 | A1 | 10/2003 |

OTHER PUBLICATIONS

International Search Report dated May 27, 2008, issued in corresponding International Application No. PCT/JP2008/054387.

ASM International, Materials Park, Ohio, Properties and Selection: Nonferrous Alloys and Special Purpose Materials: "Rare Earth Metals," Oct. 1990, vol. 2, pp. 720-732.

English Abstract and English Machine Translation of Harada et al. (JP 2005-097649) (2005).

English Abstract and English Machine Translation of Hino et al. (JP 11-256258) (1999).

Office Action issued in counterpart Chinese Patent Application No. 200880015642.1 dated Jul. 2, 2010 with the English translation.

Office Action issued in counterpart Russian Patent Application No. 2009137129 dated Jul. 6, 2010 with the English translation.

English translation of Notice of Allowance issued in counterpart Russian Patent Application No. 2009137129 dated Oct. 15, 2010.

* cited by examiner

NI-BASED SINGLE CRYSTAL SUPERALLOY AND TURBINE BLADE INCORPORATING THE SAME

CROSS-REFERENCE TO RELATED APPLICATIONS

The present application is a continuation-in-part of prior U.S. patent application Ser. No. 12/530,900, filed Sep. 11, 2009, by Akihiro Sato, Kazuyoshi Chikugo, Yasuhiro Aoki, Nobuhito Sekine, Mikiya Arai and Shoju Masaki, entitled "Ni-BASED SINGLE CRYSTAL SUPERALLOY AND TURBINE BLADE INCORPORATING THE SAME," which is a 35 U.S.C. §371 National Phase conversion of International Application No. PCT/JP2008/054387, filed Mar. 11, 2008, which claims the benefit of priority of Japanese Patent Application No. 2007-061501, filed Mar. 12, 2007. The PCT International Application was published in the Japanese language. The contents of each of the patent applications above-listed are incorporated in full herein by reference.

TECHNICAL FIELD

The present invention relates to a Ni-based single crystal superalloy and a turbine blade incorporating the same.

BACKGROUND ART

Turbine blades (stator blades and rotor blades) of aircraft engines, industrial gas turbines and other systems are often operated in high-temperature environments for a prolonged time and thus are made of a Ni-based single crystal superalloy that has an excellent heat resistance. The Ni-based single crystal superalloy is produced in the following manner. Al is first added to base Ni to cause $Ni_3Al$ to precipitate for precipitation strengthening. High melting point metals, such as Cr, W and Ta, are then added to form an alloy which is formed as a single crystal. The Ni-based single crystal superalloy acquires a metal structure suitable for strengthening through solution heat treatment at a predetermined temperature and subsequent aging heat treatment. The superalloy is called a precipitation hardened alloy which has a crystal structure with a precipitation phase (i.e., γ' phase) dispersed and precipitated in a matrix (i.e., γ phase).

As the Ni-based single crystal superalloy, a first generation superalloy contains no Re at all, a second generation superalloy contains about 3 wt % of Re, and a third generation superalloy contains 5 wt % or more to 6 wt % or less of Re, have been developed. The superalloys of later generations acquire enhanced creep strength. For example, the first generation Ni-based single crystal superalloy is CMSX-2 (Cannon-Muskegon Corporation, refer to Patent Document 1), the second generation Ni-based single crystal superalloy is CMSX-4 (Cannon Muskegon Corporation, refer to Patent Document 2) and the third generation Ni-based single crystal superalloy is CMSX-10 (Cannon Muskegon Corporation, refer to Patent Document 3).

The purpose of the third generation Ni-based single crystal superalloy, CMSX-10, is to enhance creep strength in high-temperature environments as compared to the second generation Ni-based single crystal superalloy. The third generation Ni-based single crystal superalloy, however, has a high composition ratio of Re of 5 wt % or more, which exceeds the solid solubility limit with respect to the matrix (γ phase) of Re. The excess Re may combine with other elements in high-temperature environments and as a result, a so-called TCP (topologically close packed) phase to may precipitate. A turbine blade incorporating the third generation Ni-based single crystal superalloy may acquire an increased amount of the TCP phase when operated for a prolonged time in high-temperature environments, which may impair creep strength.

In order to solve these problems, a Ni-based single crystal superalloy having higher strength in high-temperature environments has been developed. In such a superalloy, Ru for controlling the TCP phase is added and the composition ratios of other component elements are set to optimal ranges so as to provide the optimal lattice constant of the matrix (γ phase) and the optimal lattice constant of the precipitate (γ' phase).

Namely, a fourth generation Ni-based single crystal superalloy which contains about 3 wt % of Ru and a fifth generation Ni-based single crystal superalloy which contains 4 wt % or more of Ru have been developed. The superalloys of later generations acquire enhanced creep strength. For example, an exemplary fourth generation Ni-based single crystal superalloy is TMS-138 (National Institute for Materials Science (NIMS) and IHI Corporation, refer to Patent Document 4), and an exemplary fifth generation Ni-based single crystal superalloy is TMS-162 (NIMS and IHI Corporation, refer to Patent Document 5).

Patent Document 1: U.S. Pat. No. 4,582,548
Patent Document 2: U.S. Pat. No. 4,643,782
Patent Document 3: U.S. Pat. No. 5,366,695
Patent Document 4: U.S. Pat. No. 6,966,956
Patent Document 5: U.S. Patent Application, Publication No. 2006/0011271

DISCLOSURE OF INVENTION

Problem that the Invention is to Solve

The fourth and fifth generation Ni-based single crystal superalloys, however, include a large amount of heavy metal, such as W and Re, in order to enhance the creep strength in high-temperature environments, and thus have a high specific gravity as compared to the first and second generation Ni-based single crystal superalloys. As a result, a turbine blade incorporating the fourth or fifth generation Ni-based single crystal superalloy is excellent in strength in high-temperature environments, however, since the weight of the blade is increased, the circumferential speed of the turbine blade may be decreased and the weight of the aircraft engine and the industrial gas turbine may be increased. It is therefore desirable to provide a Ni-based single crystal superalloy having excellent creep strength per unit weight, i.e., having excellent specific creep strength, in order to provide a turbine blade which is lightweight and is operated at higher temperatures.

In view of these circumstances, an object of the present invention is to provide a Ni-based single crystal superalloy and a turbine blade incorporating the same having excellent specific creep strength.

Means for Solving the Problem

The inventors have made intensive studies and found that a Ni-based single crystal superalloy which has a low specific gravity as compared to the fourth and fifth generation Ni-based single crystal superalloys may be obtained by (1) specifying a composition range suitable for keeping excellent creep strength in high-temperature environments and (2) specifying a composition range suitable for structural stability, with reducing an amount of W which has a high specific gravity, and completed the present invention.

That is, the present invention has the following aspects.

(1) A Ni-based single crystal superalloy which has the following composition: Co: 4.0 to 9.5 wt %, Cr: 5.1 to 8.0 wt %, Mo: 2.1 to 3.5 wt %, W: 0.0 to 2.9 wt %, Ta: 4.0 to 10.0 wt %, Al: 4.5 to 6.5 wt %, Ti: 0.0 to 1.0 wt %, Hf: 0.08 to 0.5 wt %, Nb: 0.0 to 3.0 wt %, Re: 4.5 to 8.0 wt % and Ru: 0.5 to 6.5 wt % with the remainder including Ni and unavoidable impurities, wherein P1≤700 is satisfied in which P1 represents a parameter 1, which is obtained by a formula: P1=137×[W (wt %)]+24×[Cr (wt %)]+46×[Mo (wt %)]−18×[Re (wt %)].

(2) A Ni-based single crystal superalloy according to above (1), wherein the content of W is 0.0 to 1.9 wt %.

(3) A Ni-based single crystal superalloy which has the following composition: Co: 5.0 to 8.0 wt %, Cr: 5.1 to 8.0 wt %, Mo: 2.2 to 3.5 wt %, W: 0.0 to 1.9 wt %, Ta: 5.5 to 8.0 wt %, Al: 5.4 to 6.0 wt %, Ti: 0.0 to 0.5 wt %, Hf: 0.08 to 0.5 wt %, Nb: 0.0 to 1.0 wt %, Re: 4.5 to 7.5 wt % and Ru: 1.0 to 5.0 wt % with the remainder including Ni and unavoidable impurities.

(4) A Ni-based single crystal superalloy according to above (7), wherein P1≤700 is satisfied in which P1 represents a parameter 1, which is obtained by a formula: P1=137×[W (wt %)]+24×[Cr (wt %)]+46×[Mo (wt %)]−18×[Re (wt %)].

(5) A Ni-based single crystal superalloy according to any one of above (1) to (4), wherein P2≤500 is satisfied in which P2 represents a parameter 2, which is obtained by a formula: P2=30×[W (wt %)]+10×[Re (wt %)]−30×[Cr (wt %)]−20×[Mo (wt %)]+30×[Al (wt %)]+90×[Ti (wt %)]+60×[Ta (wt %)]−5×[Ru (wt %)].

(6) A Ni-based single crystal superalloy according to any one of above (1) to (5), further including at least one element selected from a group consisting of B, C, Si, Y, La, Ce, V and Zr.

(7) A Ni-based single crystal superalloy according to above (6), wherein the selected components are contained in the following composition: B: 0.05 wt % or less, C: 0.15 wt % or less, Si: 0.1 wt % or less, Y: 0.1 wt % or less, La: 0.1 wt % or less, Ce: 0.1 wt % or less, V: 1 wt % or less and Zr: 0.1 wt % or less.

(8) A turbine blade which incorporates the Ni-based single crystal superalloy according to any one of above (1) to (7).

Effects of the Invention

As described above, according to the present invention, an excellent creep strength in high-temperature environments can be maintained without increasing the specific gravity of the Ni-based single crystal superalloy having excellent specific creep strength. Therefore, the turbine blade incorporating the Ni-based single crystal superalloy having excellent specific creep strength may be made lightweight and may be operated at higher temperatures.

DESCRIPTION OF THE PREFERRED EMBODIMENTS

Figure 1:
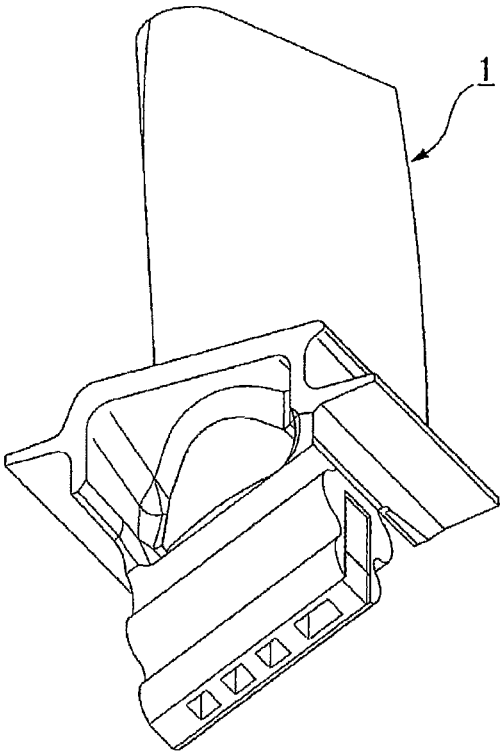
FIG. 1 is a perspective view of an exemplary turbine blade incorporating a Ni-based single crystal superalloy according to an embodiment of the present invention.

In the following, a detailed explanation for carrying out a Ni-based single crystal superalloy and a turbine blade incorporating the same according to the present invention will be explained in detail with reference to the drawings.

A single crystal Ni-based superalloy according to the present invention has the following composition: Co: 0.0 wt % to 15.0 wt %, Cr: 4.1 to 8.0 wt %, Mo: 2.1 to 6.5 wt %, W: 0.0 to 3.9 wt %, Ta: 4.0 to 10.0 wt %, Al: 4.5 to 6.5 wt %, Ti: 0.0 to 1.0 wt %, Hf: 0.00 to 0.5 wt %, Nb: 0.0 to 3.0 wt %, Re: 3.0 to 8.0 wt % and Ru: 0.5 to 6.5 wt % with the remainder including Ni and unavoidable impurities, wherein P1≤700 is satisfied in which P1 represents a parameter 1, which is obtained by a formula: P1=137×[W (wt %)]+24×[Cr (wt %)]+46×[Mo (wt %)]−18×[Re (wt %)].

A single crystal Ni-based superalloy according to the present invention also has the following composition: Co: 0.0 to 15.0 wt %, Cr: 5.1 to 8.0 wt %, Mo: 2.1 to 6.5 wt %, W: 0.0 to 3.9 wt %, Ta: 4.0 to 10.0 wt %, Al: 4.5 to 6.5 wt %, Ti: 0.0 to 1.0 wt %, Hf: 0.00 to 0.5 wt %, Nb: 0.0 to 3.0 wt %, Re: 3.0 to 8.0 wt % and Ru: 0.5 to 6.5 wt % with the remainder including Ni and unavoidable impurities, wherein P1≤700 is satisfied in which P1 represents a parameter 1, which is obtained by a formula: P1=137×[W (wt %)]+24×[Cr (wt %)]+46×[Mo (wt %)]−18×[Re (wt %)].

A single crystal Ni-based superalloy according to the present invention also has the following composition: Co: 4.0 to 9.5 wt %, Cr: 4.1 to 8.0 wt %, Mo: 2.1 to 6.5 wt %, W: 0.0 to 3.9 wt %, Ta: 4.0 to 10.0 wt %, Al: 4.5 to 6.5 wt %, Ti: 0.0 to 1.0 wt %, Hf: 0.00 to 0.5 wt %, Nb: 0.0 to 3.0 wt %, Re: 3.0 to 8.0 wt % and Ru: 0.5 to 6.5 wt % with the remainder including Ni and unavoidable impurities, wherein P1≤700 is satisfied in which P1 represents a parameter 1, which is obtained by a formula: P1=137×[W (wt %)]+24×[Cr (wt %)]+46×[Mo (wt %)]−18×[Re (wt %)].

A single crystal Ni-based superalloy according to the present invention also has the following composition: Co: 4.0 to 9.5 wt %, Cr: 5.1 to 8.0 wt %, Mo: 2.1 to 6.5 wt %, W: 0.0 to 3.9 wt %, Ta: 4.0 to 10.0 wt %, Al: 4.5 to 6.5 wt %, Ti: 0.0 to 1.0 wt %, Hf: 0.00 to 0.5 wt %, Nb: 0.0 to 3.0 wt %, Re: 3.0 to 8.0 wt % and Ru: 0.5 to 6.5 wt % with the remainder including Ni and unavoidable impurities, wherein P1≤700 is satisfied in which P1 represents a parameter 1, which is obtained by a formula: P1=137×[W (wt %)]+24×[Cr (wt %)]+46×[Mo (wt %)]−18×[Re (wt %)].

In the present invention, the content of W may be 0.0 to 2.9 wt % and may also be 0.0 to 1.9 wt % in the composition of the above-described Ni-based single crystal superalloy in order to provide the Ni-based single crystal superalloy having a low specific gravity.

A single crystal Ni-based superalloy according to the present invention also has the following composition: Co: 5.0 to 8.0 wt %, Cr: 5.1 to 8.0 wt %, Mo: 2.2 to 4.8 wt %, W: 0.0 to 1.9 wt %, Ta: 5.5 to 8.0 wt %, Al: 5.4 to 6.0 wt %, Ti: 0.0 to 0.5 wt %, Hf: 0.08 to 0.5 wt %, Nb: 0.0 to 1.0 wt %, Re: 4.0 to 7.5 wt % and Ru: 1.0 to 5.0 wt % with the remainder including Ni and unavoidable impurities.

The metal structure of the above-described Ni-based single crystal superalloy is a crystal structure with the precipitation phase (γ' phase) dispersed and precipitated in the matrix (γ phase). The γ phase consists of an austenite phase and the γ' phase consists mainly of intermetallic compounds having an ordered structure, such as $Ni_3Al$. In the Ni-based single crystal superalloy according to the present invention, the composition ratio of the γ-phase and the γ'-phase dispersed in the γ-phase may be optimized to contribute to higher strength of the superalloy to be operated in high-temperature environments.

The composition ranges of the components of the Ni-based single crystal superalloy are controlled based on their characteristics described below.

Co is an element that increases the solid solubility limit to the matrix containing Al, Ta and other elements in high-temperature environments and causes the fine γ' phase to disperse and precipitate in heat treatment so as to enhance the high-temperature strength. If more than 15.0 wt % of Co exists, the composition ratio with other elements, including Al, Ta, Mo, W, Hf and Cr, becomes unbalanced. As a result, a harmful phase precipitates to decrease the high-temperature strength. The content of Co is preferably 0.0 to 15.0 wt %, more preferably 4.0 to 9.5 wt % and most preferably 5.0 to 8.0 wt %.

Cr is an element that has excellent oxidation resistance and improves, altogether with Hf and Al, high-temperature corrosion resistance of the Ni-based single crystal superalloy. If the content of Cr is less than 4.1 wt %, it is difficult to provide a desired high-temperature corrosion resistance. If the content of Cr exceeds 8.0 wt %, precipitation of the γ' phase is inhibited and harmful phases, such as σ phase and μ phase, may precipitate to decrease the high-temperature strength. The content of Cr is therefore preferably 4.1 to 8.0 wt %, more preferably 5.1 to 8.0 wt %, and preferably 5.2 to 8.0 wt %.

Mo is an element that enhances the high-temperature strength by dissolving in the γ phase which becomes the matrix, in the presence of W or Ta, and also improves high-temperature strength due to precipitation hardening. If the content of Mo is less than 2.1 wt %, it is difficult to provide a desired high-temperature strength. If the content of Mo exceeds 6.5 wt %, the high-temperature strength decreases and the high-temperature corrosion resistance deteriorates. The content of Mo is therefore preferably 2.1 to 6.5 wt %, more preferably 2.1 to 4.8 wt %, and most preferably 2.1 to 3.5 wt %.

W is an element that enhances the high-temperature strength due to the actions of solution hardening and precipitation hardening in the presence of Mo or Ta. If the content of W exceeds 3.9 wt %, the high-temperature corrosion resistance deteriorates. The content of W is therefore preferably 0.0 to 3.9 wt %. In order to provide a Ni-based single crystal superalloy having a low specific gravity, the content of W is preferably 0.0 to 2.9 wt % and more preferably 0.0 to 1.9 wt %. In the present invention, with a small amount of W or no W at all, excellent creep strength in high-temperature environments may be kept by appropriately determining the composition ratio of other component elements.

Ta is an element that enhances the high-temperature strength due to the actions of solution hardening and precipitation hardening in the presence of Mo or W. Ta also enhances the high-temperature strength by the precipitation hardening relative to the γ' phase. If the content of Ta is less than 4.0 wt %, it is difficult to provide desired high-temperature strength. If the content of Ta exceeds 10.0 wt %, a harmful phase, such as σ phase and μ phase, may precipitate to decrease the high-temperature strength. The content of Ta is therefore preferably 4.0 to 10.0 wt % and more preferably 5.5 to 8.0 wt %.

Al combines with Ni to form a 60 to 70% (volume percentage) of an intermetallic compound represented by $Ni_3Al$, which is the fine γ' phase to be uniformly dispersed and precipitated into the matrix. That is, Al is an element that enhances the high-temperature strength altogether with Ni. Furthermore, Al is excellent in oxidation resistance, which improves, altogether with Cr and Hf, the high-temperature corrosion resistance of the Ni-based single crystal superalloy. If the content of Al is less than 4.5 wt %, the precipitation amount of the γ' phase is insufficient and it is thus difficult to provide desired high-temperature strength and high-temperature corrosion resistance. If the content of Al exceeds 6.5 wt %, a large amount of coarse eutectic γ' phase is formed, and makes difficult to provide desired high-temperature strength. Accordingly, the content of Al is preferably 4.5 to 6.5 wt % and more preferably 5.4 to 6.0 wt %.

Ti is an element that enhances the high-temperature strength due to the actions of solution hardening and precipitation hardening in the presence of Mo or W. Ti also enhances the high-temperature strength by the precipitation hardening with relative to the γ'-phase. If the content of Ti exceeds 1.0 wt %, a harmful phase, such as σ phase and μ phase, may precipitate to decrease the high-temperature strength. The content of Ti is therefore preferably 0.0 to 1.0 wt % and more preferably 0.0 to 0.5 wt %. In the present invention, with a small amount of Ti or no Ti at all, excellent creep strength in high-temperature environments may be kept by appropriately determining the composition ratio of other component elements.

Hf is an element that segregates at the grain boundary and distributed unevenly in grain boundary to strengthen the same so as to enhance the high-temperature strength when the grain boundary accidentally exists. Furthermore, Hf is excellent in oxidation resistance, and improves, altogether with Cr and Al, high-temperature corrosion resistance of the Ni-based single crystal superalloy. If the content of Hf exceeds 0.5 wt %, local melting occurs to decrease the high-temperature strength. The content of Hf is therefore preferably 0.00 to 0.5 wt % and more preferably 0.08 to 0.5 wt %.

Nb is an element that enhances the high-temperature strength. However, if the content of Nb exceeds 3.0 wt %, a harmful phase precipitates to decrease the high-temperature strength. The content of Nb is therefore preferably 0.0 to 3.0 wt % and more preferably 0.0 to 1.0 wt %. With a small amount of Nb or no Nb at all, excellent creep strength in high-temperature environments may be kept by appropriately determining the composition ratio of other component elements.

Re is an element that enhances the high-temperature strength due to solution strengthening by dissolving in the γ phase which is the matrix. Re also enhances the corrosion resistance. However, if the content of Re is less than 3.0 wt %, solution strengthening of the γ phase becomes insufficient, which makes it difficult to provide desired high-temperature strength. If the content of Re exceeds 8.0 wt %, the harmful TCP phase precipitates in high-temperature environments, which makes it difficult to provide desired high-temperature strength. The content of Re is therefore preferably 3.0 to 8.0 wt %, and more preferably 4.5 to 8.0 wt %.

Ru is an element that controls precipitation of the TCP phase to enhance the high-temperature strength. However, if the content of Ru is less than 0.5 wt %, the TCP phase precipitates in high-temperature environments, which makes it difficult to provide desired high-temperature strength. If the content of Ru exceeds 6.5 wt %, a harmful phase precipitates to decrease the high-temperature strength. The content of Ru is therefore preferably 0.5 to 6.5 wt % and more preferably 1.0 to 5.0 wt %.

The Ni-based single crystal superalloy of the present invention may further contain for example B, C, Si, Y, La, Ce, V and Zr and the like, other than incidental impurities. When the Ni-based single crystal superalloy contains at least one element selected from B, C, Si, Y, La, Ce, V and Zr, it is preferable that these elements may be included in the following composition range so as to prevent precipitation of the harmful phase which might otherwise decrease the high-temperature strength: B: 0.05 wt % or less, C: 0.15 wt % or less, Si: 0.1 wt % or less, Y: 0.1 wt % or less, La: 0.1 wt % or less, Ce: 0.1 wt % or less, V: 1 wt % or less and Zr: 0.1 wt % or less.

In the present invention, the composition range suitable for keeping excellent specific creep strength in high-temperature environments may be specified by a following parameter formula P1.

$$P1(\text{parameter 1})=137\times[W\ (wt\ \%)]+24\times[Cr\ (wt\ \%)]+46\times[Mo\ (wt\ \%)]\times18\times[Re\ (wt\ \%)]$$

The value of P1 may preferably be P1≤700, more preferably P1≤450 and even more preferably P1≤300. In the Ni-based single crystal superalloy according to the present invention, when the parameter formula P1 is satisfied, an excellent creep strength in high-temperature environments can be maintained with reducing an amount of W which has a high specific gravity.

In the present invention, the composition range suitable for structural stability is specified by the following parameter formula P2.

$$P2(\text{parameter 2})=30\times[W\ (wt\ \%)]+10\times[Re\ (wt\ \%)]-30\times[Cr\ (wt\ \%)]-20\times[Mo\ (wt\ \%)]+30\times[Al\ (wt\ \%)]+90\times[Ti\ (wt\ \%)]+60\times[Ta\ (wt\ \%)]-5\times[Ru\ (wt\ \%)]$$

The value of P2 may preferably be P2≤500 and more preferably P2≤400. In the Ni-based single crystal superalloy according to the present invention, when the parameter formula P2 is satisfied, an excellent structural stability can be performed with reducing an amount of W which has a high specific gravity.

As described above, the Ni-based single crystal superalloy according to the present invention may keep excellent creep strength in high-temperature environments without increasing the specific gravity. In the concrete, even if the content of W is as small as 2.9 wt % or less, or even as small as 1.9 wt % or less, in order to provide a Ni-based single crystal superalloy having a low specific gravity, excellent creep strength may be kept in high-temperature environments. Therefore, the Ni-based single crystal superalloy according to the present invention exhibits excellent creep strength (i.e., excellent specific creep strength) per unit density.

The Ni-based single crystal superalloy according to the present invention may be used in, for example, a turbine blade 1 as shown in FIG. 1. The turbine blade 1 incorporating the Ni-based single crystal superalloy according to the present invention has excellent creep strength in high-temperature environments and may operate for a prolonged time in high-temperature environments. I addition, the turbine blade 1 has a low specific gravity as compared to the fourth or fifth generation Ni-based single crystal superalloy. Accordingly, the turbine blade 1 may be made lightweight and may be operated at higher temperatures.

Therefore, the Ni-based single crystal superalloy according to the present invention may be incorporated in, for example, turbine blades (stator blades and rotor blades) of an aircraft engine, an industrial gas turbine and other systems. In addition, the Ni-based single crystal superalloy according to an embodiment of the present invention may also be applied to components or products to be operated for a long time in high-temperature environments.

In the present invention, the composition ratio of the γ phase and the γ' phase dispersed in the γ phase may be optimized. The invention may therefore be applied to, for example, an unidirectional solidified material and a normal casting material with similar advantageous effects of the present invention, in addition to the Ni-based single crystal superalloy.

EXAMPLES

Hereinafter, advantageous effects of the present invention will be described in more detail with reference to Examples. It is to be noted that the present invention is not limited to the Examples and various modification may be made without departing from the spirit and scope of the present invention.

First, molten metals of various kinds of Ni-based single crystal superalloys are prepared in a vacuum melting furnace. Alloy ingots of Examples 1 to 20 of varying compositions are cast from the prepared alloy molten metals. The composition ratios of the alloy ingots of Examples 1 to 20 are shown in Table 1. Table 1 also shows the composition ratios of related art Ni-based single crystal superalloys as Reference Examples 1 to 8.

TABLE 1

| | | COMPOSITION (wt %) | | | | | | | | | | | |
|---|---|---|---|---|---|---|---|---|---|---|---|---|---|
| | | Co | Cr | Mo | W | Al | Ti | Nb | Ta | Hf | Re | Ru | Ni |
| EXAMPLES | 1 | 5.50 | 5.40 | 2.20 | 2.90 | 5.60 | 0.00 | 0.50 | 5.50 | 0.10 | 7.50 | 5.00 | 59.50 |
| | 2 | 6.00 | 5.50 | 4.80 | 1.50 | 5.40 | 0.00 | 0.50 | 5.80 | 0.10 | 6.00 | 5.00 | 59.40 |
| | 3 | 6.00 | 5.40 | 5.00 | 0.00 | 5.50 | 0.00 | 0.50 | 6.20 | 0.10 | 6.40 | 5.00 | 59.90 |

TABLE 1-continued

| | | | | | | | | | | | | | |
|---|---|---|---|---|---|---|---|---|---|---|---|---|---|
| | 4 | 5.80 | 5.40 | 4.80 | 0.00 | 5.70 | 0.00 | 0.70 | 6.00 | 0.10 | 5.80 | 3.60 | 62.10 |
| | 5 | 5.80 | 5.80 | 3.80 | 1.60 | 5.90 | 0.00 | 0.50 | 6.00 | 0.10 | 5.00 | 2.00 | 63.50 |
| | 6 | 5.80 | 5.80 | 4.50 | 0.00 | 6.00 | 0.00 | 0.50 | 6.20 | 0.10 | 5.00 | 2.00 | 64.10 |
| | 7 | 5.80 | 5.80 | 4.00 | 1.80 | 6.00 | 0.00 | 0.00 | 7.00 | 0.10 | 4.00 | 1.50 | 64.00 |
| | 8 | 5.80 | 5.80 | 4.50 | 0.00 | 6.00 | 0.00 | 0.00 | 8.00 | 0.10 | 4.00 | 1.50 | 64.30 |
| | 9 | 5.80 | 6.00 | 3.40 | 2.90 | 6.00 | 0.00 | 0.00 | 6.40 | 0.10 | 4.00 | 1.50 | 63.90 |
| | 10 | 7.00 | 6.00 | 4.00 | 2.00 | 5.80 | 0.00 | 0.50 | 6.50 | 0.10 | 4.50 | 1.00 | 62.60 |
| | 11 | 5.80 | 5.40 | 3.60 | 1.60 | 5.60 | 0.00 | 0.50 | 5.90 | 0.10 | 7.00 | 5.00 | 59.50 |
| | 12 | 5.80 | 6.00 | 4.00 | 0.00 | 5.50 | 0.00 | 0.50 | 6.20 | 0.10 | 7.20 | 5.00 | 59.70 |
| | 13 | 7.00 | 7.00 | 6.50 | 0.00 | 4.80 | 0.00 | 3.00 | 4.00 | 0.10 | 4.50 | 6.00 | 57.10 |
| | 14 | 5.80 | 5.50 | 3.00 | 0.00 | 5.50 | 0.00 | 0.00 | 9.00 | 0.10 | 7.20 | 5.00 | 58.90 |
| | 15 | 5.50 | 5.60 | 3.20 | 1.90 | 5.60 | 0.00 | 0.80 | 4.10 | 0.10 | 8.00 | 5.50 | 59.70 |
| | 16 | 5.50 | 5.60 | 3.20 | 1.90 | 5.60 | 0.00 | 0.50 | 4.50 | 0.10 | 8.00 | 5.50 | 59.60 |
| | 17 | 8.00 | 5.80 | 3.80 | 1.60 | 5.90 | 0.00 | 0.50 | 6.00 | 0.10 | 5.00 | 1.00 | 62.30 |
| | 18 | 9.00 | 5.40 | 3.60 | 1.60 | 5.90 | 0.00 | 0.70 | 5.50 | 0.10 | 5.80 | 2.00 | 60.40 |
| | 19 | 5.80 | 5.10 | 3.00 | 1.90 | 6.10 | 0.00 | 0.50 | 5.00 | 0.10 | 6.00 | 3.00 | 63.50 |
| | 20 | 5.80 | 5.10 | 2.50 | 2.90 | 6.00 | 0.00 | 0.00 | 4.80 | 0.10 | 5.50 | 2.50 | 64.80 |
| REFERENCE | 1 | 5.88 | 2.94 | 2.94 | 5.88 | 5.88 | 0.00 | 0.00 | 5.88 | 0.10 | 4.90 | 2.00 | 63.60 |
| EXAMPLES | 2 | 5.82 | 2.91 | 3.88 | 5.82 | 5.82 | 0.00 | 0.00 | 5.82 | 0.10 | 4.85 | 6.00 | 58.98 |
| | 3 | 10.00 | 5.00 | 2.00 | 6.00 | 5.60 | 0.00 | 0.00 | 9.00 | 0.10 | 3.00 | 0.00 | 59.30 |
| | 4 | 9.60 | 6.40 | 0.60 | 6.40 | 5.60 | 1.00 | 0.00 | 6.50 | 0.10 | 3.00 | 0.00 | 60.80 |
| | 5 | 3.00 | 2.00 | 0.40 | 5.00 | 5.70 | 0.20 | 0.00 | 8.00 | 0.03 | 6.00 | 0.00 | 69.67 |
| | 6 | 16.50 | 2.00 | 2.00 | 6.00 | 5.55 | 0.00 | 0.00 | 8.25 | 0.15 | 5.95 | 3.00 | 50.60 |
| | 7 | 8.00 | 7.00 | 2.00 | 5.00 | 6.20 | 0.00 | 0.00 | 7.00 | 0.20 | 3.00 | 0.00 | 61.60 |
| | 8 | 12.50 | 4.20 | 1.40 | 6.00 | 5.75 | 0.00 | 0.00 | 7.20 | 0.15 | 5.40 | 0.00 | 57.40 |

| | | P1 | P2 | WEIGHT (g/cm$^3$) | LMP | ALLOY GENERATION | REMARKS |
|---|---|---|---|---|---|---|---|
| EXAMPLES | 1 | 493 | 429 | 9.02 | 29.664 | 5 | |
| | 2 | 450 | 329 | 8.89 | 29.190 | 5 | |
| | 3 | 244 | 314 | 8.87 | 29.392 | 5 | |
| | 4 | 246 | 313 | 8.75 | 28.782 | 4 | |
| | 5 | 443 | 375 | 8.72 | 28.718 | 4 | |
| | 6 | 256 | 328 | 8.63 | 28.230 | 4 | |
| | 7 | 498 | 433 | 8.70 | 28.484 | 4 | |
| | 8 | 274 | 429 | 8.66 | 28.450 | 4 | |
| | 9 | 626 | 436 | 8.72 | 28.468 | 4 | |
| | 10 | 521 | 404 | 8.72 | 28.659 | 4 | |
| | 11 | 388 | 381 | 8.92 | 29.307 | 5 | |
| | 12 | 198 | 324 | 8.86 | 28.924 | 5 | |
| | 13 | 386 | 59 | 8.80 | 29.405 | 5 | |
| | 14 | 140 | 527 | 9.01 | 29.565 | 5 | |
| | 15 | 398 | 292 | 8.91 | 29.596 | 5 | |
| | 16 | 398 | 316 | 8.92 | 29.484 | 5 | |
| | 17 | 443 | 380 | 8.69 | 28.355 | 4 | |
| | 18 | 410 | 369 | 8.74 | 28.528 | 4 | |
| | 19 | 413 | 372 | 8.73 | 28.490 | 4 | |
| | 20 | 536 | 395 | 8.73 | 28.427 | 4 | |
| REFERENCE | 1 | 923 | 598 | 8.95 | 28.744 | 4 | TMS-138 |
| EXAMPLES | 2 | 958 | 552 | 9.04 | 29.244 | 5 | TMS-162 |
| | 3 | 980 | 728 | 8.95 | 28.313 | 2 | PWA1484 |
| | 4 | 1004 | 666 | 8.70 | 28.027 | 2 | CMSX-4 |
| | 5 | 643 | 811 | 9.05 | 28.586 | 3 | CMSX-10 |
| | 6 | 855 | 786 | 9.20 | 28.591 | 4 | EPM-102 |
| | 7 | 891 | 536 | 8.70 | 27.760 | 2 | Rene'N5 |
| | 8 | 890 | 685 | 8.97 | 28.400 | 3 | Rene'N6 |

Next, the alloy ingots shown in Table 1 are subject to solution heat treatment and aging heat treatment to provide the Ni-based single crystal superalloys of Examples 1 to 20. In the solution heat treatment, the temperature is raised stepwise from 1503K-1563K (1230° C.-1290° C.) to 1573K-1613K (1300° C.-1340° C.) and kept for 1 to 10 hours or longer. In the aging heat treatment, primary aging heat treatment is conducted where the ingots are kept at 1273K to 1423K (1000° C. to 1150° C.) for 3 to 5 hours.

For each of the Ni-based single crystal superalloys of Examples 1 to 20, the condition of the alloy structure is observed with a scanning electron microscope (SEM). The TCP phase is found in neither of the alloy microstructures.

Next, the Ni-based single crystal superalloys of Examples 1 to 20 are subject to a creep test at the temperature of 1000° C. to 1050° C. and under the stress of 245 MPa. The test is continued until a creep rupture of the samples, and the duration time is defined as creep life.

The creep life is then evaluated per specific gravity (density: g/cm$^3$) of each of the Ni-based single crystal superalloys of Examples 1 to 20 and the Reference Examples 1 to 8 using the Larson-Miller parameter (LMP) shown below. The results of the evaluation are shown in Table 1. A characteristic chart representing the relationship between the specific gravity of superalloys of Example 1 to 20, Comparative Examples 1 to 8 and the LMP is shown in FIG. 2.

$$LMP=(T+273)\times(20+\text{Log } t)/1000$$

wherein T represents the temperature (° C.) and t represents the creep rupture time (hours).

Figure 2:
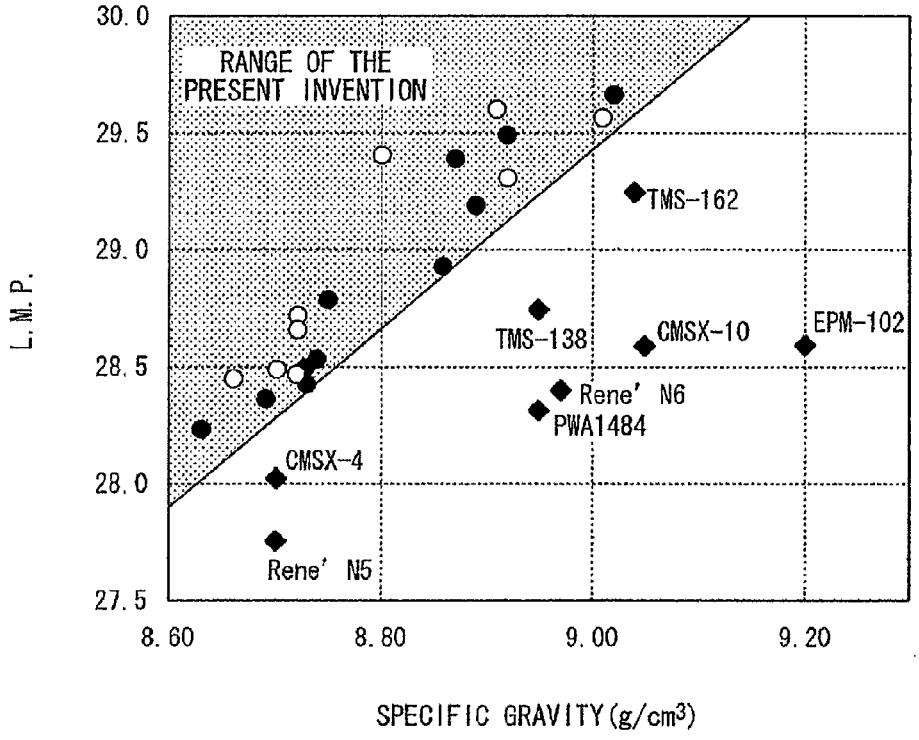
FIG. 2 is a characteristic chart showing a relationship between density and LMP in Examples and Reference Examples shown in Table 1.

As shown in Table 1 and FIG. 2, the Ni-based single crystal superalloys of Examples 1 to 20 have higher LMP values per specific gravity as compared to the Ni-based single crystal superalloys of Reference Examples 1 to 8.

The Ni-based single crystal superalloys of Examples 1, 9, 10 and 20 with reduced W content of 2.9 wt % or less still have excellent creep strength per specific gravity. The Ni-based single crystal superalloys of Examples 2, 5, 7, 11 and 15 to 19 with reduced W content of 1.9 wt % or less still have excellent creep strength per specific gravity. The Ni-based single crystal superalloys of Examples 3, 4, 6, 8 and 12 to 14 with no W at all still have excellent creep strength per specific gravity.

Subsequently, the Ni-based single crystal superalloy according to an embodiment of the present invention has excellent specific creep strength.

Next, effects of Cr, Re and Mo in the Ni-based single crystal superalloy will be described in more detail.

Figure 3:
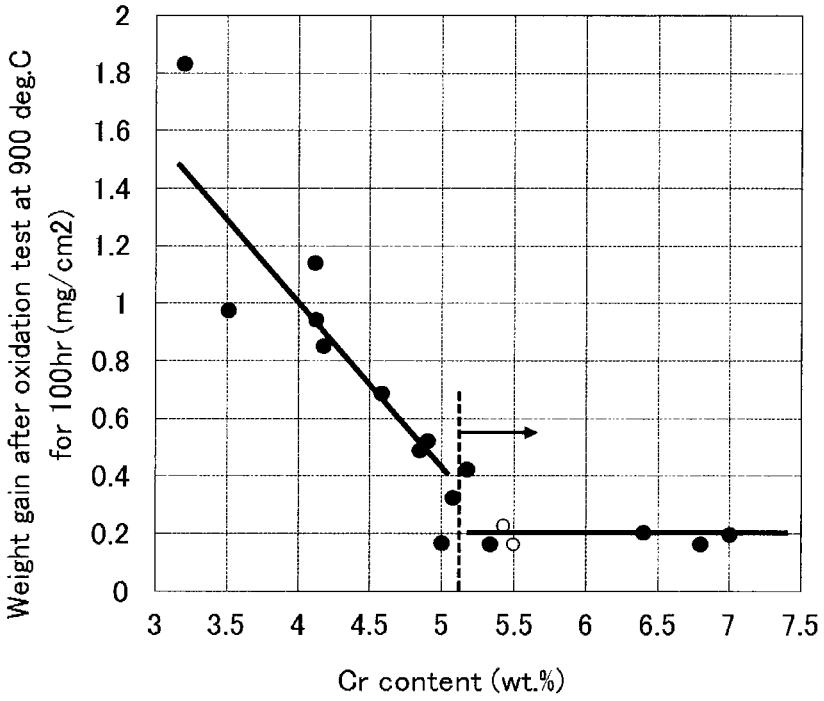
FIG. 3 is a graph showing relation between Cr content in a Ni-based single crystal superalloy and weight gain after oxidation test.

FIG. 3 is a graph showing relation between Cr content in a Ni-based single crystal superalloy and weight gain after oxidation test. In the oxidation test, cylindrical specimens of about 10 mm in diameter and about 5 mm in thickness are machined. All surface is polished by #600 emery paper and degreased by alcohol or ketone. Then each specimen is put into a ceramic crucible and kept for 100 hrs at 900 deg.C. in air. The weight change of specimen and crucible is measured by the electric balance.

As shown in FIG. 3, in the Ni-based single crystal superalloy in which the alloys of the present invention belongs to, when the composition of Cr in the alloy exceeds 5 wt %, weight gain per unit time due to oxidation of the alloy clearly decreases. Accordingly, Ni-based single crystal superalloy which includes 5.1 wt % or more (and more preferably, 5.2 wt % or more) of Cr clearly advantageous over the alloy which includes 5% or less of Cr in their oxidation resistance.

Figure 4A:
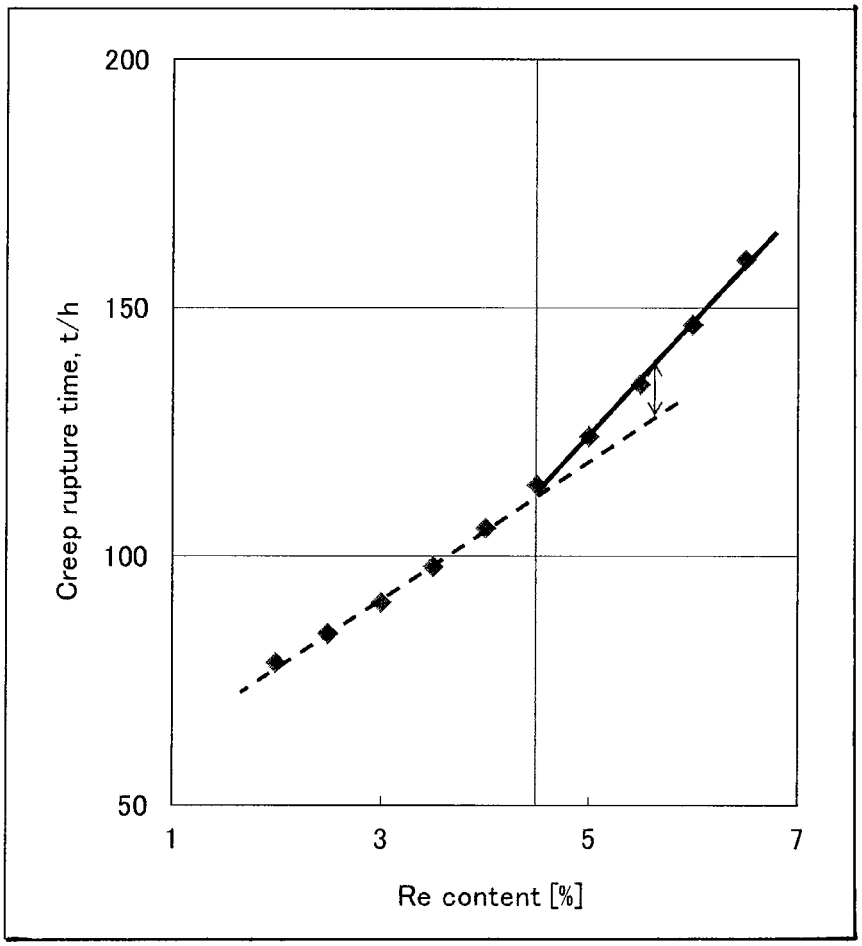
FIG. 4A is a graph showing relation between Re content in a Ni-based single crystal superalloy and creep rupture time.
Figure 4B:
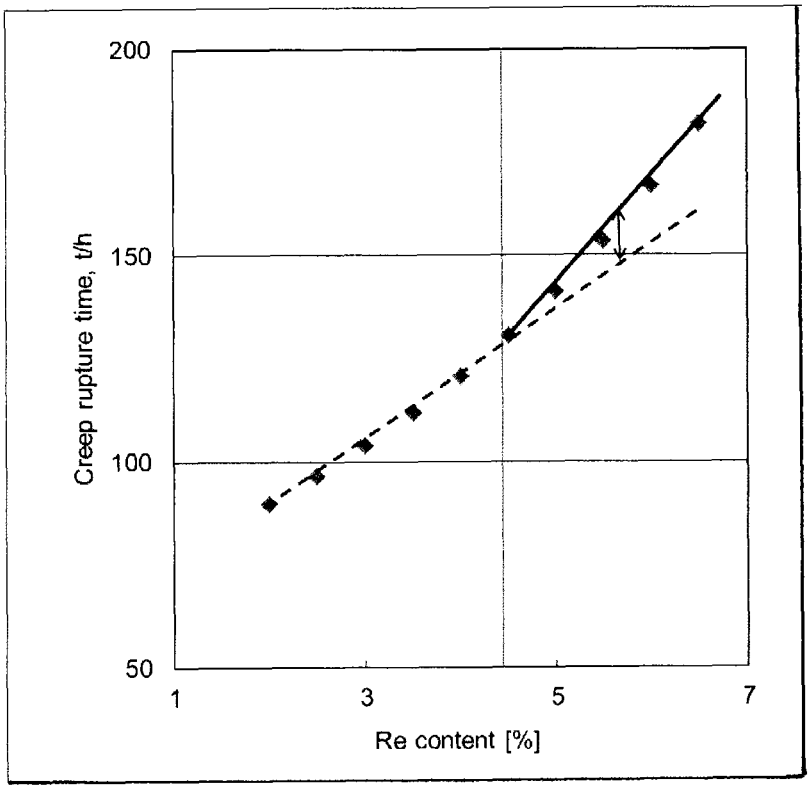
FIG. 4B is a graph showing relation between Re content in a Ni-based single crystal superalloy and creep rupture time.
Figure 4C:
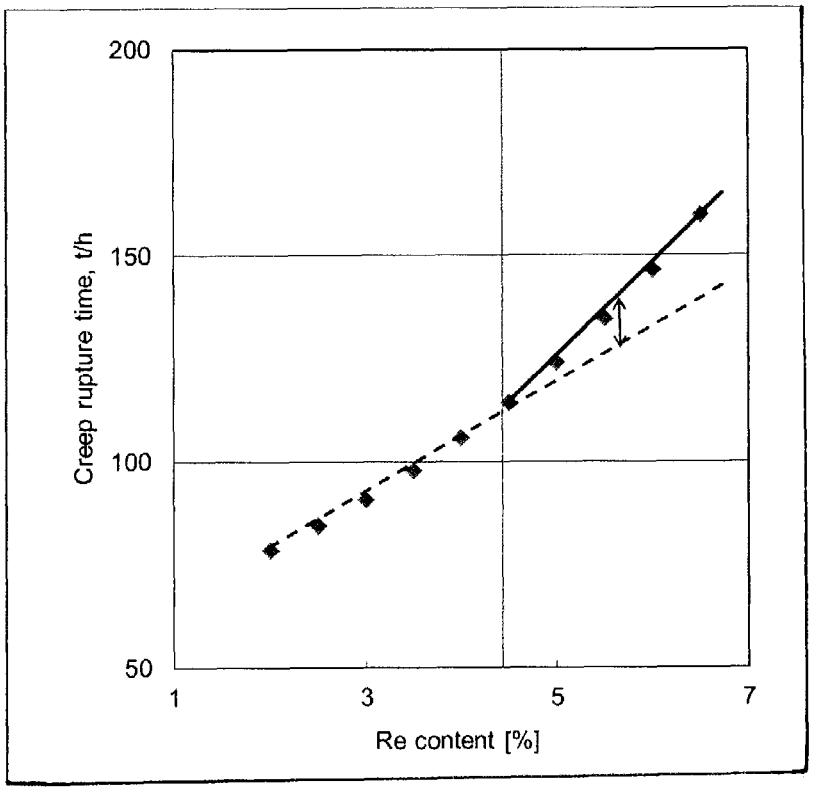
FIG. 4C is a graph showing relation between Re content in a Ni-based single crystal superalloy and creep rupture time.

FIGS. 4A to 4C are graphs showing relation between Re content in a Ni-based single crystal superalloy and creep rupture time obtained by simulations carried out using "JMatPro V.5.0" developed by Sente Software Co. of Great Britain. FIGS. 4A, 4B and 4C are results of simulations when composition of Re in the alloys corresponding to examples 1, 2 and 3 of the present invention are changed respectively.

As shown in FIGS. 4A to 4C, in the alloy of the present invention, when the composition of Re in the alloy exceeds 4.5 wt %, the creep life (creep rupture time) nonlinearly extends. Accordingly, the alloy of the present invention obtains advantageous effects with regards to its creep life by adding 4.5 wt % or more of Re.

Figure 5A:
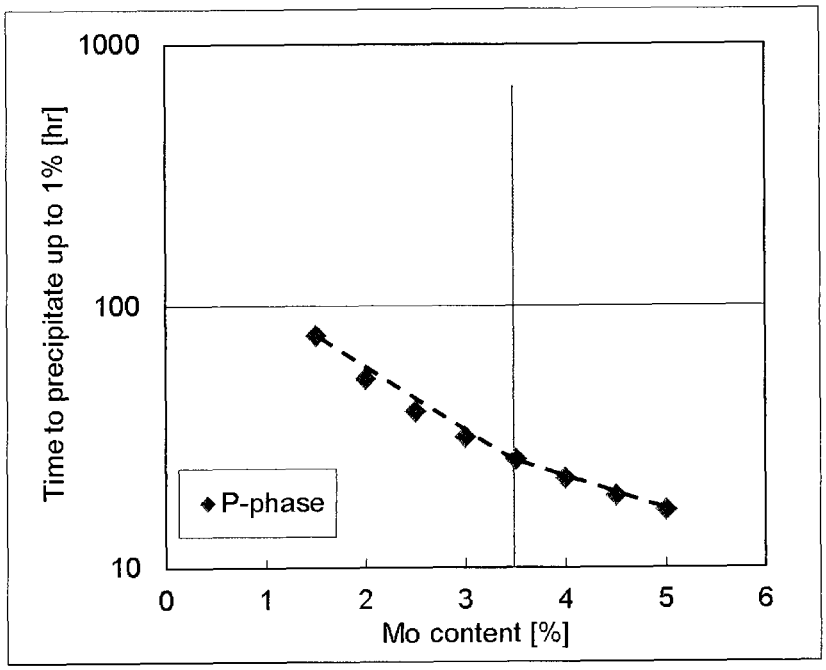
FIG. 5A is a graph showing relation between Mo content in a Ni-based single crystal superalloy and precipitation time of P-phase.
Figure 5B:
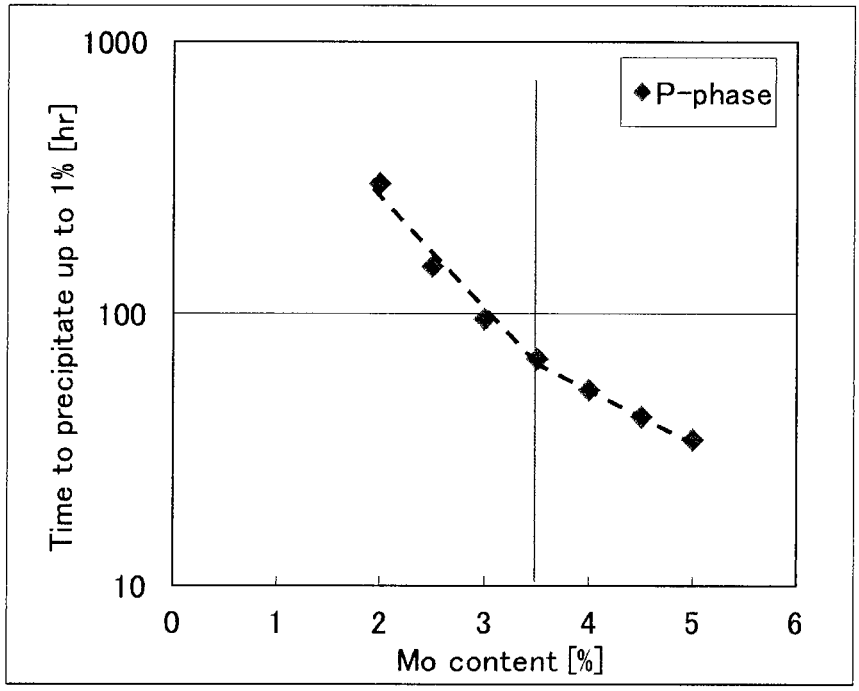
FIG. 5B is a graph showing relation between Mo content in a Ni-based single crystal superalloy and precipitation time of P-phase.
Figure 5C:
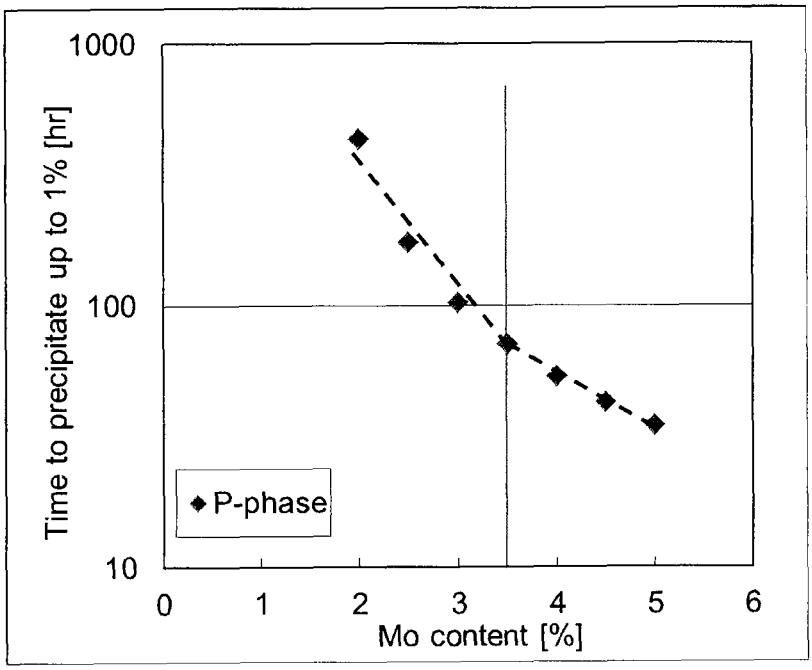
FIG. 5C is a graph showing relation between Mo content in a Ni-based single crystal superalloy and precipitation time of P-phase.

FIGS. 5A to 5C are graphs showing relation between Mo content in a Ni-based single crystal superalloy and precipitation time of P-phase obtained by simulations carried out using "JMatPro V.5.0". FIGS. 5A, 5B and 5C are results of simulations when composition of Mo in the alloys corresponding to examples 1, 2 and 3 of the present invention are changed respectively.

As shown in FIGS. 5A to 5C, in the alloy of the present invention, the precipitation time of harmful precipitation phase (P-phase) in the alloy is shortened in accordance with the composition of Mo in the alloy increases. In addition, when the composition of Mo in the alloy exceeds 3.5 wt %, the precipitation time of P-phase nonlinearly changes. Accordingly, the alloy of the present invention having the distinctive properties with regards to the precipitation of P-phase by limiting the composition of Mo in the alloy to 3.5 wt % or less.

INDUSTRIAL APPLICABILITY

According to the present invention, the Ni-based single crystal superalloy may have excellent specific creep strength, and therefore, the turbine blade incorporating the Ni-based single crystal superalloy having excellent specific creep strength may be made lightweight and may be operated at higher temperatures.

What is claimed is:

1. A Ni-based single crystal superalloy which has the following composition: Co: 4.0 to 9.5 wt %, Cr: 5.1 to 8.0 wt %, Mo: 2.1 to 3.5 wt %, W: 0.0 to 1.5 wt %, Ta: 4.0 to 10.0 wt %, Al: 4.5 to 6.5 wt %, Ti: 0.0 to 1.0 wt %, Hf: 0.08 to 0.5 wt %, Nb: 0.5 to 3.0 wt %, Re: 4.5 to 8.0 wt % and Ru: 0.5 to 6.5 wt % with the remainder including Ni and unavoidable impurities, wherein $P1 \leq 700$ is satisfied in which P1 represents a parameter 1, which is obtained by a formula: $P1=137\times[W\ (wt\ \%)]+24\times[Cr\ (wt\ \%)]+46\times[Mo\ (wt\ \%)]-18\times[Re\ (wt\ \%)]$.

2. A Ni-based single crystal superalloy according to claim 1, wherein $P2 \leq 500$ is satisfied in which P2 represents a parameter 2, which is obtained by a formula: $P2=30\times[W\ (wt\ \%)]+10\times[Re\ (wt\ \%)]-30\times[Cr\ (wt\ \%)]-20\times[Mo\ (wt\ \%)]+30\times[Al\ (wt\ \%)]+90\times[Ti\ (wt\ \%)]+60\times[Ta\ (wt\ \%)]-5\times[Ru\ (wt\ \%)]$.

3. A Ni-based single crystal superalloy according to claim 1, further comprising at least one element selected from a group consisting of B, C, Si, Y, La, Ce, V and Zr.

4. A Ni-based single crystal superalloy according to claim 3, wherein the selected components are contained in the following composition: B: 0.05 wt % or less, C: 0.15 wt % or less, Si: 0.1 wt % or less, Y: 0.1 wt % or less, La: 0.1 wt % or less, Ce: 0.1 wt % or less, V: 1 wt % or less and Zr: 0.1 wt % or less.

5. A turbine blade which incorporates the Ni-based single crystal superalloy according to claim 1.

6. A Ni-based single crystal superalloy which has the following composition: Co: 5.0 to 8.0 wt %, Cr: 5.1 to 8.0 wt %, Mo: 2.2 to 3.5 wt %, W: 0.0 to 1.5 wt %, Ta: 5.5 to 8.0 wt %, Al: 5.4 to 6.0 wt %, Ti: 0.0 to 0.5 wt %, Hf: 0.08 to 0.5 wt %, Nb: 0.5 to 1.0 wt %, Re: 4.5 to 7.5 wt % and Ru: 1.0 to 5.0 wt % with the remainder including Ni and unavoidable impurities.

7. A Ni-based single crystal superalloy according to claim 6, wherein $P1 \leq 700$ is satisfied in which P1 represents a parameter 1, which is obtained by a formula: $P1=137\times[W\ (wt\ \%)]+24\times[Cr\ (wt\ \%)]+46\times[Mo\ (wt\ \%)]-18\times[Re\ (wt\ \%)]$.

8. A turbine blade which incorporates the Ni-based single crystal superalloy according to claim 6.

* * * * *